US009062280B2

(12) United States Patent
Zhu et al.

(10) Patent No.: US 9,062,280 B2
(45) Date of Patent: Jun. 23, 2015

(54) LIQUID CLEANING COMPOSITION

(75) Inventors: Shui-Ping Zhu, Berwyn, PA (US); Keith R. Genco, Pottstown, PA (US); Stephen W. Carson, Coatesville, PA (US)

(73) Assignee: Arkema Inc., King Of Prussia, PA (US)

( * ) Notice: Subject to any disclaimer, the term of this patent is extended or adjusted under 35 U.S.C. 154(b) by 0 days.

(21) Appl. No.: 13/388,518

(22) PCT Filed: Aug. 4, 2010

(86) PCT No.: PCT/US2010/044362

§ 371 (c)(1), (2), (4) Date: Feb. 7, 2012

(87) PCT Pub. No.: WO2011/017406

PCT Pub. Date: Feb. 10, 2011

(65) Prior Publication Data

US 2012/0129755 A1 May 24, 2012

Related U.S. Application Data

(60) Provisional application No. 61/231,829, filed on Aug. 6, 2009.

(51) Int. Cl.

| | |
|---|---|
| ***C11D 1/22*** | (2006.01) |
| ***C11D 1/90*** | (2006.01) |
| ***C11D 1/94*** | (2006.01) |
| ***C11D 3/39*** | (2006.01) |
| ***C11D 3/395*** | (2006.01) |

(Continued)

(52) U.S. Cl.

CPC ..... *C11D 3/3947* (2013.01); *C11D 1/16* (2013.01); *C11D 1/88* (2013.01); *C11D 3/3945* (2013.01); *C11D 1/14* (2013.01); *C11D 1/90* (2013.01); *C11D 3/3942* (2013.01); *C11D 3/3902* (2013.01); *C11D 1/12* (2013.01); *C11D 1/22* (2013.01); *C11D 1/94* (2013.01)

(58) Field of Classification Search

CPC ..... C11D 1/14; C11D 1/16; C11D 1/22; C11D 1/88; C11D 1/90; C11D 1/94; C11D 3/3902; C11D 3/3942; C11D 3/3945; C11D 3/3947

USPC ..... 510/221, 237, 238, 303, 309, 337, 351, 510/370, 501

See application file for complete search history.

(56) References Cited

U.S. PATENT DOCUMENTS

| | | | |
|---|---|---|---|
| 1,985,424 | A | 12/1934 | Piggott |
| 2,082,275 | A | 6/1937 | Daimler |

(Continued)

FOREIGN PATENT DOCUMENTS

| | | | |
|---|---|---|---|
| EP | 0 062 523 | A2 | 10/1982 |
| EP | 0 217 501 | A2 | 4/1985 |

(Continued)

*Primary Examiner* — Gregory R Delcotto

(74) *Attorney, Agent, or Firm* — Steven D. Boyd

(57) ABSTRACT

The present invention relates to a liquid cleaning composition comprising a peroxygen bleach, a sulfonated anionic surfactant and an amphoteric/zwitterionic surfactant where the sulfonated anionic surfactant and the amphoteric/zwitterionic surfactants are in a ratio of from 0.1:1 to 13:1. The combination of the sulfonated anionic surfactant and the amphoteric/zwitterionic surfactants provides for high viscosities and improved cleaning performance.

8 Claims, 2 Drawing Sheets

(51) Int. Cl.

| | |
|---|---|
| ***C11D 1/16*** | (2006.01) |
| ***C11D 1/88*** | (2006.01) |
| ***C11D 1/14*** | (2006.01) |
| *C11D 1/12* | (2006.01) |

(56) References Cited

U.S. PATENT DOCUMENTS

| | | | |
|---|---|---|---|
| 2,255,082 | A | 9/1941 | Orthuer et al. |
| 2,703,798 | A | 3/1955 | Schwartz |
| 2,965,576 | A | 12/1960 | Wilson |
| 3,812,044 | A | 5/1974 | Connor et al. |
| 3,933,672 | A | 1/1976 | Bartolotto et al. |
| 4,021,365 | A | 5/1977 | Sinka et al. |
| 4,076,648 | A | 2/1978 | Rosen |
| 4,259,201 | A | 3/1981 | Cockrell, Jr. et al. |
| 4,704,233 | A | 11/1987 | Hartman |
| 4,749,740 | A | 6/1988 | Aizawa et al. |
| 4,818,425 | A | 4/1989 | Meiier et al. |
| 4,983,316 | A | 1/1991 | Starch |
| 6,448,214 | B1 | 9/2002 | Del Duca et al. |
| 6,475,970 | B1 | 11/2002 | Del Duca et al. |
| 6,482,786 | B1 | 11/2002 | Del Duca et al. |
| 2003/0096726 | A1 | 5/2003 | Smith et al. |
| 2003/0154556 | A1* | 8/2003 | Del Duca et al. ..... 8/115.51 |
| 2005/0119146 | A1 | 6/2005 | Rodrigues |

FOREIGN PATENT DOCUMENTS

| | | | |
|---|---|---|---|
| EP | 0 499 364 | A1 | 8/1992 |
| EP | 0 150 872 | A1 | 5/1993 |
| EP | 0 573 699 | A1 | 12/1993 |
| EP | 0 908 512 | A2 | 4/1999 |
| GB | 809 060 | | 2/1959 |
| GB | 1 586 769 | | 3/1981 |
| GB | 2 143 231 | A | 2/1985 |
| JP | 3111494 | A | 5/1991 |
| JP | 20030124994 | A | 1/2003 |
| WO | WO 92/06070 | | 4/1992 |
| WO | WO 98/49257 | | 11/1998 |
| WO | WO 00/27971 | | 5/2000 |
| WO | WO 2006/108475 | | 10/2006 |

* cited by examiner

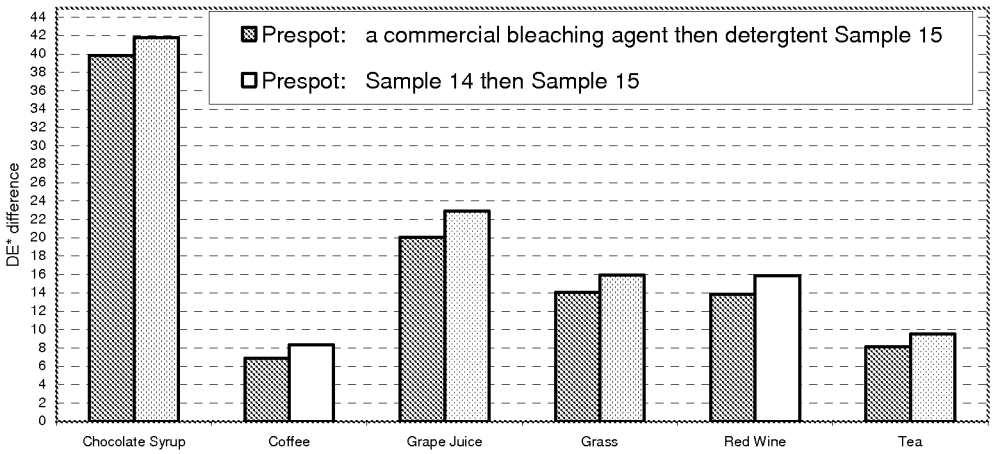
Figure 1 Prespot Detergency test of Sample 14 vs a commercial bleaching agent on different Stains
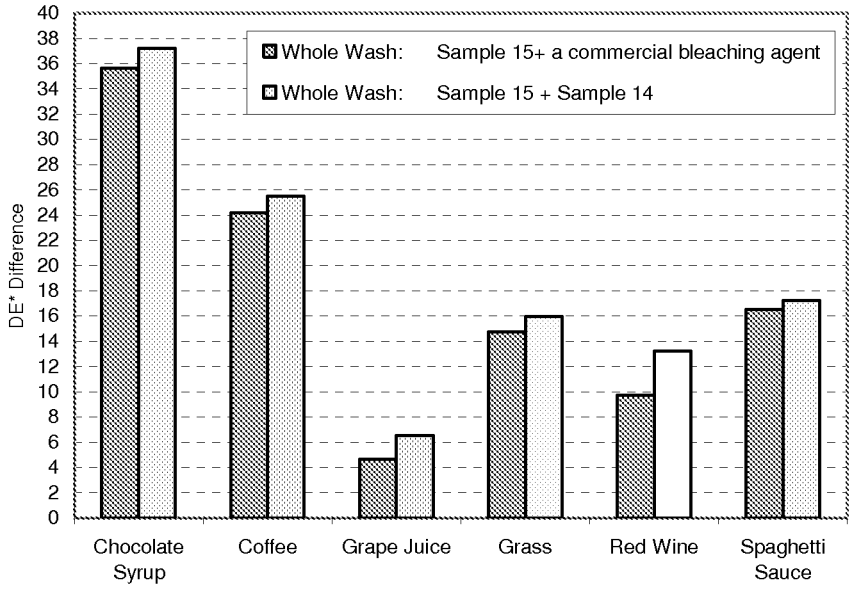
Figure 2 Whole Wash detergency test of Sample 14 vs. a commercial bleaching agent

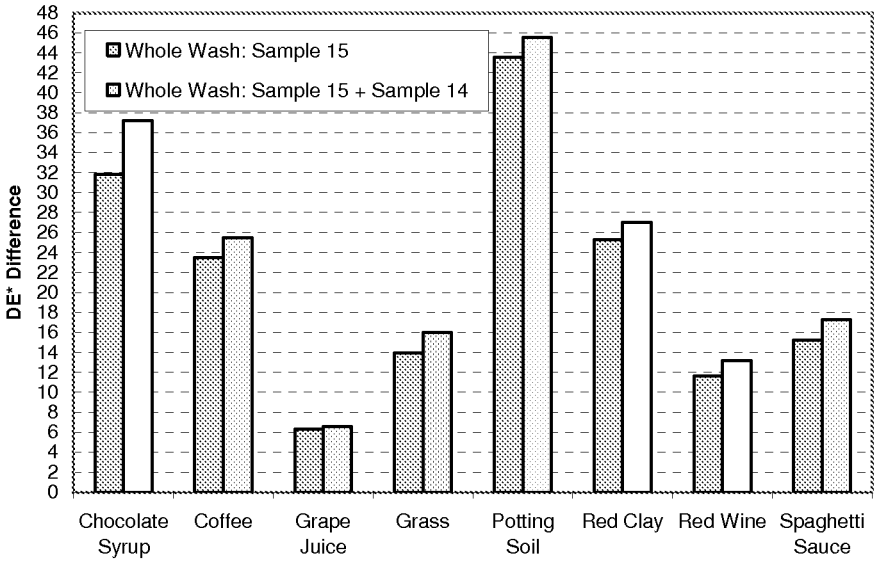
Figure 3: Whole wash detergency test of Sample 14 as extra

LIQUID CLEANING COMPOSITION

FIELD OF THE INVENTION

The present invention is directed to liquid cleaning compositions. Such compositions are suitable for use in various laundry applications such as laundry pretreatment or whole laundry wash of various fabrics to provide stain removal and bleaching performance or for use as a hard surface or carpet cleaner.

BACKGROUND OF THE INVENTION

Bleach containing compositions for bleaching fabrics and treating surfaces are well known in the art. Liquid peroxygen bleach containing compositions have been extensively described in the art, especially in laundry applications as laundry detergents, laundry additives or laundry pretreaters. The use of such peroxygen bleach containing compositions in laundry applications to boost the removal of encrusted stains and soils such as grease, coffee, tea, grass, mud/clay containing soils which are otherwise particularly difficult to remove by typical machine washing is known in the art.

Although the known liquid aqueous bleaching compositions provide some bleaching performance when used to treat a soiled fabric, there is room for further improvement regarding the stain removal performance on various stains including for example greasy stains as well as for further improvement in bleaching performance under various conditions such as pretreatment conditions where the liquid composition is applied neat on the fabric to bleach before the fabric is rinsed or washed then rinsed with water.

It is know that the stain removal performance of liquid aqueous peroxygen bleach containing compositions may be improved by the addition of a surfactant or a surfactant system. For example liquid bleaching compositions having a pH below 7, comprising a peroxygen bleach, a sulphonated anionic surfactant and a second surfactant selected from nonionic surfactants amphoteric surfactants, zwitterionic surfactants and mixtures thereof is disclosed in WO 00/27971.

However, there are some limitations to the convenience of such liquid bleaching compositions. In particular, the stain removal performance is not yet fully satisfactory for the consumer and the viscosity of such combinations is typically low such that thickener agents such as polymers are added to provide a gel like consistency.

It is there for an object of the present invention to provide a liquid bleaching composition whereby the composition shows good stain removal performance and a gel like viscosity without the addition of polymeric thickeners.

It has been found that the object can be efficiently met by a formulating a liquid bleaching composition comprising a peroxygen bleach and a sulphonated anionic surfactant and an amphoteric/zwitterionic surfactant where the ratio of amphoteric/zwitterionic surfactant to sulfonated anionic surfactant is greater than about 0.3. The liquid bleaching composition of the present invention exhibits a viscosity of up to 28,800 centipoise without the additional of any polymeric or other thickening agents. It was found that the specific surfactant combination of the present invention could provide both viscosity enhancement and increase stain removal performance.

DETAILED DESCRIPTION OF THE INVENTION

The compositions according to the present invention are formulated as liquids as opposed to a solid or a gas. 'Liquids' include gel and paste forms.

Preferred compositions of the present invention have a viscosity of 10 cps or greater, more preferably of from 10 cps to 50,000 cps, even more preferably of from 10 cps to 3,000 cps at 20° C. when measured with a Brookfield viscometer at 20 rpm with a spindle n° 4, unless otherwise indicted. All percentages herein are by weight unless specified otherwise.

Preferred liquid compositions of the present invention are aqueous and therefore, preferably comprise water, more preferably comprise water in an amount of from 60% to 99%, even more preferably of from 70% to 98% and most preferably 80% to 97.5% by weight of the total composition.

The pH of the liquid composition of the present invention can range from 1 to 13 and may be adjusted by any acids and bases known to those skilled in the art. Examples of acids and bases are sulfuric acid, hydrochloric acid, nitric acid, phosphoric acid, citric acid, methyl sulfonic acid, sodium hydroxide, potassium hydroxide, alkaline silicate, monoethanolamine, triethanolamine etc.

Peroxygen Bleach

As a first essential element the compositions according to the present invention comprise a peroxygen bleach or a mixture thereof. Indeed, the presence of a peroxygen bleach contributes to the excellent bleaching benefits of said compositions. Suitable peroxygen bleaches to be used herein are selected from the group consisting of: hydrogen peroxide; water soluble sources of hydrogen peroxide; organic or inorganic peracids; hydroperoxides; diacyl peroxides; and mixtures thereof.

As used herein a hydrogen peroxide source refers to any compound that produces perhydroxyl ions when said compound is in contact with water. Suitable water-soluble sources of hydrogen peroxide for use herein include percarbonates, perborates and persilicates and mixtures thereof. Suitable diacyl peroxides for use herein include aliphatic, aromatic and aliphatic-aromatic diacyl peroxides, and mixtures thereof.

Suitable aliphatic diacyl peroxides for use herein are dilauroyl peroxide, didecanoyl peroxide, dimyristoyl peroxide, or mixtures thereof. A suitable aromatic diacyl peroxide for use herein is for example benzoyl peroxide. A suitable aliphatic-aromatic diacyl peroxide for use herein is for example lauroyl benzoyl peroxide. Such diacyl peroxides have the advantage of being particularly safe to fabrics and color while delivering excellent bleaching performance when used in laundry applications.

Suitable organic or inorganic peracids for use herein include: persulphates such as monopersulfate; peroxyacids such as diperoxydodecandioic acid (DPDA); magnesium perphthalic acid; peracetic acid, perlauric acid; perbenzoic and alkylperbenzoic acids; and mixtures thereof.

Suitable hydroperoxides for use herein include tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage of being particularly safe to fabrics and color while delivering excellent bleaching performance when used in laundry applications.

Preferred peroxygen bleaches herein are selected from the group consisting of: hydrogen peroxide; water soluble sources of hydrogen peroxide; organic or inorganic peracids; hydroperoxides; and diacyl peroxides; and mixtures thereof. More preferred peroxygen bleaches herein are selected from the group consisting of hydrogen peroxide and diacyl peroxides and mixtures thereof. Even more preferred peroxygen bleaches herein are selected from the group consisting of hydrogen peroxide, aliphatic diacyl peroxides, aromatic diacyl peroxides and aliphatic-aromatic diacyl peroxides and mixtures thereof.

Typically, the compositions herein may comprise from 0.01% to 20%, preferably from 0.3% to 15% and more preferably from 0.5% to 10% by weight of the total composition of said peroxygen bleach or a mixture thereof.

Sulphonated Anionic Surfactant

As a second essential ingredient the compositions according to the present invention comprise a sulphonated anionic surfactant. Suitable sulphonated anionic surfactants for use herein are all those commonly known by those skilled in the art. Preferably, the sulphonated anionic surfactants for use herein include alkyl sulphonates, alkyl aryl sulphonates, naphthalene sulphonates, alkyl alkoxylated sulphonates, C6-C20 alkyl alkoxylated linear or branched diphenyl oxide disulphonates, or mixtures thereof.

Suitable alkyl sulphonates for use herein include water-soluble salts or acids of the formula RSO3M wherein R is a C6-C20 linear or branched, saturated or unsaturated alkyl group, preferably a C8-C18 alkyl group and more preferably a C10-C17 alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula RSO3M wherein R is an aryl, preferably a benzyl, substituted by a C6-C20 linear or branched saturated or unsaturated alkyl group, preferably a C8-C18 alkyl group and more preferably a C10-C16 alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

By "linear alkyl sulphonate" it is meant herein a non-substituted alkyl sulphonate wherein the alkyl chain comprises from 6 to 20 carbon atoms, preferably from 8 to 18 carbon atoms, and more preferably from 14 to 17 carbon atoms, and wherein this alkyl chain is sulphonated at one terminus.

Suitable alkoxylated sulphonate surfactants for use herein are according to the formula R(A)mSO3M wherein R is an unsubstituted C6-C20 alkyl, hydroxyalkyl or alkyl aryl group, having a linear or branched C6-C20 alkyl component, preferably a C12-C20 alkyl or hydroxyalkyl, more preferably C12-C18 alkyl or hydroxyalkyl, A is an ethoxy or propoxy or butoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl$_7$ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are C12-C18 alkyl polyethoxylate (1.0) sulphonate (C12-C18E(1.0)SM), C12-C18 alkyl polyethoxylate (2.25) sulphonate (C12-C18E(2.25)SM), C12-C18 alkyl polyethoxylate (3.0) sulphonate (C12-C18E(3.0)SM), and C12-C18 alkyl polyethoxylate (4.0) sulphonate (C12-C18E(4.0)SM), wherein M is preferably selected from sodium and potassium. Particularly suitable alkoxylated sulphonate include alkyl aryl polyether sulphonate.

Suitable C6-C20 alkyl alkoxylated linear or branched diphenyl oxide disulphonate surfactants for use herein are according to the following formula:

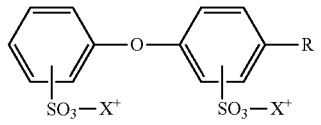

wherein R is a C6-C20 linear or branched, saturated or unsaturated alkyl group, preferably a C12-C18 alkyl group and more preferably a C14-C16 alkyl group, and X+ is H or a cation, e.g., an alkali metal cation (e.g., sodium, potassium, lithium, calcium, magnesium and the like). Particularly suitable C6-C20 alkyl alkoxylated linear or branched diphenyl oxide disulphonate surfactants to be used herein are the C12 branched diphenyl oxide disulphonic acid and C16 linear diphenyl oxide disulphonate sodium salt.

Preferably said sulphonated anionic surfactant for use herein is selected from the group consisting of: alkyl sulphonates; alkyl aryl sulphonates; alkyl alkoxylated sulphonates; C6-C20 alkyl alkoxylated linear or branched diphenyl oxide disulphonates; naphthalene sulphonates; and mixtures thereof. More preferably said sulphonated anionic surfactant for use herein is an alkyl sulphonate. Even more preferably said sulphonated anionic surfactant for use herein is an alkylbenzene sulphonate. Most preferably said sulphonated anionic surfactant for use herein is a C10-C17 alkylbenzene sulphonate.

Typically, the compositions according to the present invention comprise from 0.01% to 25%, preferably from 0.1% to 15% and more preferably from 0.2% to 7% by weight of the total composition of a sulphonated anionic surfactant.

The weight ratio of amphoteric/zwitterionic surfactant to the sulphonated anionic surfactant can range from about 0.02:1 to 10:1, preferably said weight ratio of the amphoteric/zwitterionic surfactant to the sulphonated anionic surfactant is from about 0.05:1 to 8:1, more preferably from about 0.1:1 to 3:1. Another aspect of the present invention is the use of a sulphonated anionic surfactant as described above in a liquid composition to treat fabrics whereby said compositions provide stain removal benefits.

Second Surfactant

As a third essential ingredient the compositions according to the present invention comprise a second amphoteric/zwitterionic surfactant.

Suitable amphoteric/zwitterionic surfactants to be used herein include betaine, sulfonated betaine, imidazoline, hydrolyzed imidazoline type surfactants.

The betaine type comprise the general formula:

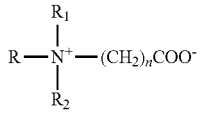

-continued $R = R_3—(OR_4)_m—$ or $= R_3C(=O)—NR_5—$ or $= R_3C(=O)—O—$ wherein $R_5$ is H, or hydroxyl alkyl with 2 to 3 carbon atoms, or hydroxylpolyethyleneoxide. $R_4$ is the alkylene group with 2 to 3 carbon atoms. $R_3$ is an alkyl, hydroxyalkyl or alkylphenyl, saturated or unsaturated with from 8 to 22 carbon atoms. $R_1$ and $R_2$ are alkyl or hydroxyl alkyl group with 1 to 4 carbon atoms, m=0 to 5 and n=1 to 4.

The sulfonated betaine type comprise the general formula:

$R—N^+(R_1)(R_2)—(CH_2)_nCH(R_6^-)CH_2SO_3^-$ wherein $R = R_3—(OR_4)_m—$ or $= R_3C(=O)—NR_5—$ or $= R_3C(=O)—O—$.

wherein $R_6$ is the H or OH. $R_5$ is H, or hydroxyl alkyl with 2 to 3 carbon atoms, or hydroxylpolyethyleneoxide. $R_4$ is an alkylene group with 2 to 3 carbon atoms. $R_3$ is an alkyl, hydroxyalkyl or alkylphenyl, saturated or unsaturated, with from 8 to 22 carbon atoms. $R_1$ and $R_2$ are alkyl or hydroxyl alkyl group with 1 to 4 carbon atoms, m=0 to 5 and n=0 to 4.

The imidazoline type comprise the general formula:

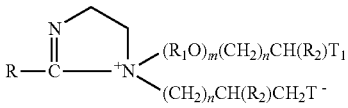

$(R_1O)_m(CH_2)_nCH(R_2)T_1$ wherein $(CH_2)_nCH(R_2)CH_2T^-$ $R = R_3—(OR_4)_m—$ or $= R_3C(=O)—NR_5—$ or $= R_3C(=O)—O—$ wherein $R_5$ is the H, or hydroxyl alkyl with 2 to 3 carbon atoms, or hydroxylpolyethyleneoxide. $R_4$ is an alkylene group with 2 to 3 carbon atoms. $R_3$ is an alkyl, hydroxyalkyl or alkylphenyl, saturated or unsaturated, with from 8 to 22 carbon atoms. $R_2$ is H or OH. $R_1$ is an alkylene with 2 to 3 carbon atoms, $T = —COO^-$ or $—SO_3^-$, $T_1 = H$, or —OH or $(TM^+)$, M is H, alkali metal, alkali earth metal ammonium or alkanolammonium, m=0 to 5 and n=0 to 4.

The hydrolyzed imidazoline type comprise the general formula:

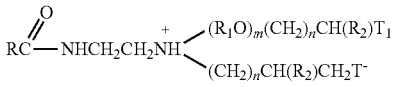

$R = R_3—(OR_4)_m—$ or $= R_3C(=O)—NR_5—$ or $= R_3C(=O)—O—$ wherein the symbols have the same meanings as above for the imidazoline type.

Optional Ingredients

The compositions herein may further comprise a variety of other optional ingredients such as chelating agents, builders, other surfactants, hydrotropes, stabilizers, bleach activators, solvents, soil suspenders, soil suspending polyamine polymers, soil release agents, foam reducing systems, radical scavengers, antioxidant, catalysts, dye transfer inhibitors, rheology modifiers, brighteners, perfumes, pigments and dyes.

Other Surfactants

The compositions of the present invention may further comprise other surfactants than the ones mentioned herein before including a second anionic surfactants and/or a non-ionic surfactants. Typically, the compositions according to the present invention may comprise from 0.01% to 30%, preferably from 0.1% to 25% and more preferably from 0.5% to 20% by weight of the total composition of another surfactant on top of the sulphonated anionic surfactant and the amphoteric/zwitterionic surfactant.

Suitable other anionic surfactants to be used in the compositions herein include water-soluble salts or acids of the formula ROSO3M wherein R preferably is a C10-C24 hydrocarbyl, preferably an alkyl or hydroxyalkyl having a C10-C20 alkyl component, more preferably a C12-C18 alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like). Typically, alkyl chains of C12-16 are preferred for lower wash temperatures (e.g., below 50° C.) and C16-18 alkyl chains are preferred for higher wash temperatures (e.g., above 50° C.).

Other suitable other anionic surfactants for use herein are water-soluble salts or acids of the formula RO(A)mSO3M wherein R is an unsubstituted C10-C24 alkyl or hydroxyalkyl group having a C10-C24 alkyl component, preferably a C12-C20 alkyl or hydroxyalkyl, more preferably C12-C18 alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are C12-C18 alkyl polyethoxylate (1.0) sulfate, (C12-C18E(1.0)SM), C12-C18 alkyl polyethoxylate (2.25) sulfate (C12-C18E(2.25)SM), C12-C18 alkyl polyethoxylate (3.0) sulfate (C12-C18E(3.0)SM), and C12-C18 alkyl polyethoxylate (4.0) sulfate (C12-C18E (4.0)SM), wherein M is conveniently selected from sodium and potassium.

Other suitable anionic surfactants to be used herein also include acyl sarcosinate or mixtures thereof, in its acid and/or salt form, preferably long chain acyl sarcosinates having the following formula:

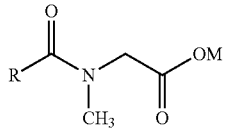

wherein M is hydrogen or a cationic moiety and wherein R is an alkyl group of from 11 to 15 carbon atoms, preferably of from 11 to 13 carbon atoms. Preferred M is hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include C12 acyl sarcosinate (i.e., an acyl sarcosinate according to the above formula wherein M is hydrogen and R is an alkyl group of 11 carbon atoms) and C14 acyl sarcosinate (i.e., an acyl sarcosinate according to the above formula wherein M is hydrogen and R is an alkyl group of 13 carbon atoms).

Hydrotropes

As an optional ingredient the compositions according to the present invention may comprise a hydrotrope. Suitable hydrotropes herein include sulphonated hydrotropes. Any sulphonated hydrotropes known to those skilled in the art are suitable for use herein. In a preferred embodiment alkyl aryl sulphonates or alkyl aryl sulphonic acids are used. Preferred alkyl aryl sulphonates include sodium, potassium, calcium and ammonium xylene sulphonates, sodium, potassium, calcium and ammonium toluene sulphonates, sodium, potassium, calcium and ammonium cumene sulphonates, sodium, potassium, calcium and ammonium substituted or unsubstituted naphthalene sulphonates and mixtures thereof. Preferred alkyl aryl sulphonic acids include xylene sulphonic acid, toluene sulphonic acid, cumene sulphonic acid, substituted or unsubstituted naphthalene sulphonic acid and mixtures thereof. More preferably, xylene sulphonic acid or p-toluene sulphonate or mixtures thereof are used.

Typically, the compositions herein may comprise from 0.01% to 20%, preferably from 0.05% to 10% and more preferably from 0.1% to 5% by weight of the total composition of a sulphonated hydrotrope. The sulphonated hydrotrope, when present, contributes to the physical and chemical stability of the compositions as described herein.

Chelating Agents

The compositions of the present invention may comprise a chelating agent as a preferred optional ingredient. Suitable chelating agents may be any of those known to those skilled in the art such as the those selected from the group comprising phosphonate chelating agents, amino carboxylate chelating agents, other carboxylate chelating agents, polyfunctionally substituted aromatic chelating agents, ethylenediamine N,N'-disuccinic acids or mixtures thereof.

A chelating agent may be desired in the compositions of the present invention as it allows to increase the ionic strength of the compositions herein and thus their stain removal and bleaching performance on various surfaces. The presence of chelating agents may also contribute to reduce the tensile strength loss of fabrics and/or color damage, especially in a laundry pretreatment application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents to be used herein may include alkali metal ethane 1-hydroxy diphosphonates (HEDP), alkylene poly(alkylene phosphonate), as well as amino phosphonate compounds, including amino tri(methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Polyfunctionally-substituted aromatic chelating agents may also be useful in the compositions herein. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid (especially the (S,S) isomer), or alkali metal, or alkaline earth, ammonium or substitutes ammonium salts thereof, ethylenediamine N,N'-disuccinic acid or mixtures thereof.

Suitable amino carboxylates to be used herein include ethylene diamine tetra acetates, diethylene triamine pentaacetate (DTPA), N-hydroxyethylethylenediamine triacetates, nitrilotriacetates, ethylenediamine tetrapropionates, triethylenetetraaminehexaacetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) and methyl glycine di-acetic acid (MGDA).

Further carboxylate chelating agents to be used herein include salicylic acid, aspartic acid, glutamic acid, glycine, malonic acid or mixtures thereof. Another chelating agent for use herein is of the formula:

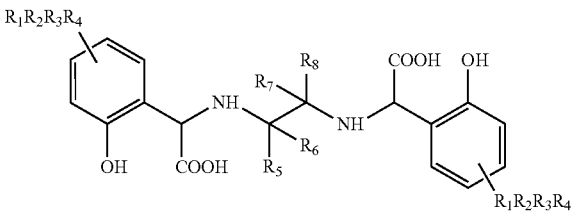

wherein R1, R2, R3, and R4 are independently selected from the group consisting of —H, alkyl, alkoxy, aryl, aryloxy, —Cl, —Br, —NO2, —C(O)R', and —SO2R"; wherein R' is selected from the group consisting of —H, —OH, alkyl, alkoxy, aryl, and aryloxy; R" is selected from the group consisting of alkyl, alkoxy, aryl, and aryloxy; and R5, R6, R7, and R8 are independently selected from the group consisting of —H and alkyl. Particularly preferred chelating agents to be used herein are aminotri(methylene phosphoric acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention may comprise up to 5%, preferably from 0.01% to 1.5% by weight and more preferably from 0.01% to 0.5% by weight of the total composition of a chelating agent.

Foam Reducing System

The compositions according to the present invention may further comprise a foam reducing agent or a mixture thereof. Any foam reducing agents known to those skilled in the art are suitable for use herein. In a preferred embodiment a foam reducing system comprising a fatty acid together with a capped alkoxylated nonionic surfactant as defined herein after and/or silicone is used.

Typically, the compositions herein may comprise from 1.10-4% to 10%, preferably from 1.10-3% to 5% and more preferably from 1.10-2% to 5% by weight of the total composition of a fatty acid.

Typically, the compositions herein may comprise from 1.10-3% to 20%, preferably from 1.10-2% to 10% and more preferably from 5-10-2% to 5% by weight of the total composition of a capped alkoxylated nonionic surfactant as defined herein.

Typically, the compositions herein may comprise from 1-10-5% to 5%, preferably from 1.10-6% to 1% and more preferably from 1.10-4% to 0.5% by weight of the total composition of a silicone.

Suitable fatty acids for use herein are the alkali salts of a C8-C24 fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms.

Suitable fatty acids may be selected from caprylic acid, capric acid, lauric acid, myristic acid, palmitic acid, stearic acid, and mixtures of fatty acids suitably hardened, derived from natural sources such as plant or animal esters (e.g., palm oil, coconut oil, soybean oil, castor oil, tallow, ground oil, whale and fish oils and/or babassu oil.

Suitable capped alkoxylated nonionic surfactants for use herein are according to the formula: R1(O—CH2-CH2)n-(OR2)m-O—R3 wherein R1 is a C8-C24 linear or branched alkyl or alkenyl group, aryl group, alkaryl group, preferably R1 is a C8-C18 alkyl or alkenyl group, more preferably a C10-C18 alkyl or alkenyl group, even more preferably a C10-C15 alkyl group; wherein R2 is a C1-C10 linear or branched alkyl group, preferably a C2-C10 linear or branched alkyl group, preferably a C3 group; wherein R3 is a C1-C10 alkyl or alkenyl group, preferably a C1-C5 alkyl group, more preferably methyl; and wherein n and in are integers independently ranging in the range of from 1 to 20, preferably from 1 to 10, more preferably from 1 to 5; or mixtures thereof.

Suitable silicones for use herein include any silicone and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the silicone is advantageously releasably incorporated in a water-soluble or water-dispersible, substantially non-surface-active detergent impermeable carrier. Alternatively, the silicone can be dissolved or dispersed in a liquid carrier and applied by spraying on to one or more of the other components.

Actually in industrial practice, the term "silicone" has become a generic term which encompasses a variety of relatively high-molecular-weight polymers containing siloxane units and hydrocarbyl groups of various types. The silicone compounds disclosed therein are suitable in the context of the present invention. Generally, the silicone compounds can be described as siloxanes having the general structure:

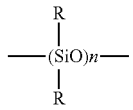

wherein n is from 20 to 2000, and where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end blocking units and having a viscosity at 25° C. of from 5×10-5 m2/s to 0.1 m2/s, i.e., a value of n in the range 40 to 1500. These are preferred because of their ready availability and their relatively low cost.

A preferred type of silicone compounds useful in the compositions herein comprises a mixture of an alkylated siloxane of the type herein above disclosed and solid silica.

The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 m2/g. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from 2×10-4 m2/s to 1 m2/s. Preferred silicone compounds may have a viscosity in the range of from 5×10-3 m2/s to 0.1 m2/s. Particularly suitable are silicone compounds with a viscosity of 2×10-2 m2/s or 4.5×102 m2/s.

Radical Scavenger

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tertbutyl hydroxy toluene Radical scavengers when used, are typically present herein in amounts ranging up to 10% and preferably from 0.001% to 0.5% by weight of the total composition.

The presence of radical scavengers may contribute to reduce tensile strength loss of fabrics and/or color damage when the compositions of the present invention are used in any laundry application, especially in a laundry pretreatment application.

Antioxidant

The compositions according to the present invention may further comprise an antioxidant. Typically, the compositions herein may comprise up to 10%, preferably from 0.002% to 5%, more preferably from 0.005% to 2%, and most preferably from 0.01% to 1% by weight of the total composition of an antioxidant.

Suitable antioxidants to be used herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof. Preferred antioxidants for use herein are citric acid, ascorbic acid, ascorbil palmitate, lecithin or mixtures thereof.

Bleach Activator

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach.

Suitable bleach activators to be used herein include those belonging to the class of esters, amides, imides, or anhydrides. Examples of suitable compounds to be used herein are tetracetyl ethylene diamine (TAED), sodium 3,5,5 trimethyl hexanoyloxybenzene sulphonate, diperoxy dodecanoic acid and nonylamide of peroxyadipic acid and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particularly preferred family of bleach activators is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

The compositions according to the present invention may comprise from 0.01% to 20%, preferably from 0.1% to 10%, and more preferably from 0.5% to 7% by weight of the total composition of said bleach activator.

EXAMPLES

Example 1

Viscosity

The viscosity of samples was measured using a Brookfield Viscometer-RVTD with spindle 4 at 20 rpm and 75 F, unless otherwise specified. Table 1 summarizes the results of viscosity measurements for various surfactants and mixtures. For all viscosities less than 20, a No 4 spindle was used at 100 rpm. For sample 4, spindle No. 4 was used at 2.5 rpm.

TABLE 1

Viscosity Summary of 13 Different Samples

| | 1 | 2 | 3 | 4 | 5 | 6 | 7 | 8 | 9 | 10 | 11 | 12 | 13 |
|---|---|---|---|---|---|---|---|---|---|---|---|---|---|
| Cocamidopropyl betaine (amphoteric) | 4.00 | 600 | 4.00 | 3.00 | 2.00 | 2.00 | 1.50 | 4.00 | 4.00 | | | | |
| Sodium alkyl benzene sulfonate (anionic) | | 1.00 | 1.00 | 1.00 | 1.00 | 2.00 | 3.00 | | | 4.00 | 2.00 | 4.00 | 2.00 |
| Alcohol ethoxylate 7 EO (nonionic) | | | | | | | | 1.00 | | 1.00 | 2.00 | | |
| C16 pyridium chloride (cationic) | | | | | | | | | 1.00 | | | | |
| Fatty alcohol sulfate (anionic) | | | | | | | | | | | | 1.00 | 2.00 |
| Sodium citrate | 2.19 | 2.19 | 2.19 | | 2.19 | 2.19 | 2.19 | 2.19 | 2.19 | 2.19 | 2.19 | 2.19 | 2.19 |
| Sodium sulfate | | | | 3.00 | | | | | | | | | |
| NaOH to final pH | | | | | | | | | | | | | |
| Water | To 100 | To 100 | To 100 | To 100 | To 100 | To 100 | To 100 | To 100 | To 100 | To 100 | To 100 | To 100 | To 100 |
| Total Surfactants | 4.00 | 7.00 | 5.00 | 4.00 | 3.00 | 4.00 | 4.50 | 5.00 | 5.00 | 5.00 | 4.00 | 5.00 | 4.00 |
| Ratio Amphoteric/sulfonate | 4/0 | 6/1 | 4/1 | 3/1 | 2/1 | 1/1 | 1/2 | | | | | | |
| Viscosity (C.P.) at 75° F. at | | | | | | | | | | | | | |
| pH 2 | | 2430 | | | | | | | | | | | |
| PH 3 | | 4200 | | | | | | | | 6 | 6 | 8 | 12 |
| PH 4 | | | | | | | 1100 | | | | | | |
| PH 7 | 3 | 1750 | 3150 | | 1400 | 200 | 340 | 4 | 10 | 10 | 10 | 8 | 12 |
| PH 10 | | | | 28800 | | | | | | | | | |
| PH 12 | | 3120 | | | 1500 | | | | | 14 | 18 | 8 | 12 |

The data in Table 1 shows the high viscosity provided by the combination of amphoteric and sulfonated anionic surfactants of the present invention. Samples 2 to 7 show that at low total active surfactant levels of 3% to 7%, the combination of the amphoteric and the sulphonated anionic can result a high viscosity of from 200 to 28800 cps without the need for additional viscosity enhancers such as polymeric thickeners. The amphoteric surfactant alone (sample 1), or the combination of amphoteric surfactant and nonionic or cationic surfactant (samples 8 and 9) do not generate comparable high viscosities. Samples 10 to 13 show that the combination of sulphonate surfactant with nonionic or other anionic surfactant do not generate the high viscosity provided by the combination of the present invention.

Example 2

Prespot Detergency Test

A 1 ml sample composition or a commercial bleaching agent was placed onto the center of a stained area of a stained cloth and allowed to sit for 10 minutes. Clothes pretreated with the same sample were washed in a washing machine with a lab made detergent. After a regular wash and rinse cycle, the cloths were dried and read by a Spectraflash SF650X stain reading machine. The DE* difference is the difference between the stain reading before and after washing. The larger the DE* difference, the better the cleaning effect of a product. The data shown in FIG. 1 summarizes the results. The DE* difference numbers in FIG. 1 are averages of 4 replicates tests for each type of stain.

FIG. 1 shows the "prespot" detergency of the formulation of sample 14 with amphoteric and sulphonate vs. a commercial prespot treatment at the same test condition. From FIG. 1, it can be seen that the formulation of sample 14, in accordance with the present invention, as a prespot works better in stains of chocolate, coffee, grape juice, grass, red wine and tea than the commercial product.

Example 3

Whole Wash Detergency 48.0 grams of a lab made detergent (sample 15), a combination of 48.0 grams of a lab made detergent (sample 15) with 96 grams of a commercial bleach agent and a combination of 48.0 grams of sample 15 with 48.0 grams of sample 14 (in accordance with the present invention) were put in to standard washing machines and washed using the wash test process described above in for "Prespot Detergency". The results are summarized in FIGS. 2 and 3. FIG. 2 compares the detergency of a combination of a lab made detergent & a commercial bleaching agent versus a combination of the lab made detergent & a formulation in accordance with the present invention. FIG. 3 compares the detergency of a lab made detergent versus a combination of a lab made detergent and a formulation in accordance with the present invention.

FIG. 2 shows that the combination of the present invention (sample 14) with the lab made detergent (sample 15) provides better detergency than a combination of the lab made detergent (sample 15) and a commercial bleaching agent on stains of chocolate, coffee, grape juice, red wine and spaghetti sauce FIG. 3 shows that the combination of the present invention (sample 14) with the lab made detergent (sample 15) provides better detergency than the lab made detergent (sample 15) on stains of chocolate, coffee, grass, potting soil, red clay, red wine and spaghetti sauce when used in combination with the lab-made detergent (sample 15).

The formulations of Samples 14 and 15 are shown in Table 2

TABLE 2

| | Sample 14 | Sample 15 |
|---|---|---|
| Cocamidopropyl betaine | 4.00% | |
| Sodium alkylbenzene sulfonate | 0.27% | 3.00% |
| Sodium alcohol ethoxylate-3 sulfate | 2.73% | 5.00% |
| C12 alcohol ethoxylate 7 EO | | 5.000% |
| Coco fatty acid | | 2.00% |
| Sodium citrate | 0.67% | 2.02% |
| Tetrasodium iminodicuccinate | | 0.50% |
| Fluorecent dye | 0.20% | |
| Limonene | .20% | |
| Peroxal CG-HP ($H_2O2$) | 7.60% | 7.60% |
| Perfume | | 0.20% |
| Miscellaneous | | 0.50% |
| Water | To 100% | To 100% |

What is claimed is:

1. A liquid composition comprising a peroxygen bleach, a sodium alkyl benzene sulphonated anionic surfactant and a cocamidopropyl betine amphoteric surfactant, wherein the weight ratio of sulphonated anionic surfactant to amphoteric surfactant is from 1:3 and the composition has a pH from 10 to 12 and a viscosity of 28800 centipoise.

2. The composition of claim 1 wherein said peroxygen bleach comprises from about 0.2 to 15 wt % of said composition.

3. The composition of claim 1 wherein said peroxygen bleach comprises from about 1 to 10 wt % of said composition.

4. The composition of claim 1 wherein said peroxygen bleach comprises from about 2 to 8 wt % of said composition.

5. The composition of claim 1 wherein said peroxygen bleach is selected from the group consisting of hydrogen peroxide, water soluble sources of hydrogen peroxide, organic peracids, inorganic peracids, hydroperoxides; diacyl peroxides and mixtures thereof.

6. The composition of claim 1 wherein the sulfonated anionic and the amphoteric surfactants comprise from about 1% to 20% by weight of said composition.

7. The composition of claim 1 wherein the sulfonated anionic and the amphoteric surfactants comprise from about 1.5% to 15% by weight of said composition.

8. The composition of claim 1 wherein the sulfonated anionic and the amphoteric surfactants comprise from about 2% to 10% by weight of said composition.

* * * * *